US008487824B1

(12) United States Patent
Josypenko

(10) Patent No.: US 8,487,824 B1
(45) Date of Patent: Jul. 16, 2013

(54) ZERO DEGREE GRID ANTENNA

(75) Inventor: Michael J. Josypenko, Norwich, CT (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 289 days.

(21) Appl. No.: 12/880,361

(22) Filed: Sep. 13, 2010

(51) Int. Cl.
*H01Q 19/00* (2006.01)
*H01Q 13/00* (2006.01)

(52) U.S. Cl.
USPC ..... 343/756; 343/773; 343/774; 343/807; 343/909

(58) Field of Classification Search
USPC ..... 343/756, 773, 774, 807, 909
See application file for complete search history.

(56) References Cited

U.S. PATENT DOCUMENTS 3,271,771 A * 9/1966 Hannan et al. ..... 343/756
4,728,961 A * 3/1988 Bossuet et al. ..... 343/756

* cited by examiner

*Primary Examiner* — Douglas W Owens
*Assistant Examiner* — Patrick Holecek
(74) *Attorney, Agent, or Firm* — James M. Kasischke; Jean-Paul A. Nasser; Michael P. Stanley

(57) ABSTRACT

A vertically polarized dipole or bicone antenna is positioned cylindrically with in many cylindrical layers of polarizing grids that slowly rotate the incident field to cross 0 degrees, i.e., 90 degrees to the horizon, and to attenuate or minimize the effects of gain nulls from reflections off of the innermost grid layer. Such an antenna is used for detecting both horizontal and vertical polarized signals over a broad bandwidth whereby the response to both polarizations is equal.

19 Claims, 14 Drawing Sheets

212
228
45°, $0_G$
236
234
240
230
226
232
210
30°
208
15°
206
224
225
0°
216

ZERO DEGREE GRID ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

This application is related to a patent application filed on the same day by the same inventor entitled CAPACITIVE LOADED GRID ANTENNA.

BACKGROUND OF THE INVENTION (1) Field of the Invention

The present invention generally relates to vertically polarized RF antennas and more specifically to bicone and dipole antennas.

(2) Description of the Prior Art

In the signal detection environment, it is often desirable to detect both horizontal and vertical polarized signals on the horizon over a broad bandwidth. It is also desirable that the response to both polarizations is equal. Optionally, an antenna may be used in a vertical stack of antennas, which requires cables to pass vertically by the antenna to other antennas above the antenna.

A typical solution to detecting both horizontal and vertical polarized signals over a broad bandwidth whereby the response to both polarizations is equal, is to use a vertically polarized bicone antenna positioned cylindrically in many cylindrical layers of polarizing grids that slowly rotate the incident field from cross 45 degrees to close to cross 0 degrees (90 degrees to the horizon, vertically polarized), as shown in FIGS. 1A and 1B. Grids pass signals that are cross or perpendicular to, the grid angle or pitch angle of the grids.

The components of to-be-received horizontal and vertical polarized signals of equal amplitude are of equal amplitude at cross 45 degrees. Thus for equal response to either polarization, the grid and bicone configuration receives this component of either of the polarizations. A bare minimum of three layers of grids of grid angles 45, 30 and 15 degrees rotates the cross 45 degree component from respectively cross 45 to cross 30, and to cross 15.

The bicone inside of the 15 degree grid layer finally receives the signal at cross 0 degrees (vertical polarization, 90 degrees to the horizon). One layer of 45 degree grids is a possible configuration that passes a to-be-received signal component of cross 45 degrees to the cross 0 degrees vertical polarization of the bicone, although there is a 3 decibel polarization mismatch loss.

In general, the amount of rotation of polarization to be done by the grids determines the bare minimum number of grid layers that is needed to minimize to a reasonably small value the polarization mismatch loss of the grids. A reasonable rule dictates that at least one grid layer is needed per 15 degrees of rotation. Thus 45 degrees of rotation requires three grid layers with grid angles of 45, 30 and 15 degrees.

The grid layers are arranged radially so that the layers of larger grid angles have corresponding larger radii. In other words, a grid layer's pitch angle will increase directly with an increase in radius.

In all configurations, with the length of the grid lines long enough to cause reflections, the distance between adjacent grid layers must be less than ½ wavelength (½λ) and the distance between the innermost grid layer and the axis of the bicone must be less than 1 wavelength. At ½ or 1 wavelength separations, cancellation of the incident and reflected signals occurs respectively between adjacent grid layers or the innermost grid layer and the axis of the bicone, causing a problematic signal gain null and degraded patterns. For the innermost grid layer and the axis of the bicone case, this null also occurs at higher integer multiples of a half wavelength, e.g., 1.5, 2.5 . . . wavelengths, although of decreasing intensity as the integer multiples of a half wavelength increases.

NEC (Numeric Electromagnetic Code) government models using a narrow dipole antenna instead of a bicone antenna in the configuration have shown that cancellation between the innermost grid layer and a dipole starts at 0.5, not 1.0, wavelength separation. It is not known if the difference between the two cases is dependent upon the use of a bicone or a dipole.

Resultant problems and additional problems of using grids external to the bicone are noted below.

The distance between the innermost grid and a bicone axis can quickly approach 1 wavelength at which cancellation occurs, especially if the bicone is being used at frequencies where it is electrically large, i.e., larger than 1 wavelength.

Additionally, the grids are parasites of finite size and thus can have resonances, e.g., circumferential resonances in this configuration.

Circumferential resonances occur when the circumference of the grid layer is an integer multiple of a wavelength. Such resonances usually severely degrade the required azimuthal omni patterns of the bicone at the frequencies of the resonances, due to re-radiation or reflection off of the grids. The resonances appear as negative spikes or nulls when illustrated in gain versus frequency plots.

Resonances can be expected to be made less severe by making the grids more broadband by making them larger. For example, the heights of the grids can be increased. However, measurements have indicated that increasing grid height has little effect on decreasing pattern degradation at resonance frequencies.

Additionally, the circumference of grid layers can be made larger so that higher order resonances appear in the frequency band of interest. The worse case resonance is when the circumference is 1 wavelength. Usually resonances when the circumference is 3 or more wavelengths can be ignored since pattern degradation is small.

Typical measurements, such as for a configuration of a bicone inside 15 and 30 degree layers of grids, have shown the following severity of gain nulls (see TABLE 1).

TABLE 1

| Resonance Circumference of Outermost Grid Layer (wavelengths) | Gain Null Depth (decibels) |
|---|---|
| 1 | −35 |
| 2 | −7 |

Vertical and horizontal polarization gain (decibel) versus frequency (wavelength) plots for all azimuths are shown in respective FIGS. 2 and 3. First and second nulls are noted for each grid layer, $N1_{15}$, $N1_{30}$, $N2_{15}$ and $N2_{30}$, respectively. The frequencies in FIG. 2 and FIG. 3 corresponding to the respective 1 and 2 wavelength circumferences of the 15 degree grid layer are noted at $1\lambda_{15°}$ and $2\lambda_{15°}$ whereas the frequencies corresponding to the respective 1 and 2 wavelength circumferences of the 30 degree grid layer are noted at $1\lambda_{30°}$ and $2\lambda_{30°}$. Notice that nulls are located at or close to the circumferential wavelength points.

Note that a small space separates the 15 degree and 30 degree grids with the 30 degree grids being a little larger in radius and circumference. This results in the resonances of both grids not being exactly at the same frequency. The 30 degree grid resonances are a little lower in frequency than those of the 15 degree grids. The 1λ and 2λ resonance frequencies for both grids are shown on FIGS. 1 and 2. The double resonances are seen with the first null being actually composed of two closely spaced nulls $N1_{15}$ and $N1_{30}$, and the second null composed of two closely spaced nulls $N2_{15}$ and $N2_{30}$.

The nulls are at or close to the circumferential wavelength points. Gains for horizontal polarization and below the first null are spread out since the antenna configuration was below its cut-in frequency resulting in the feed cable of the bicone starting to become part of the antenna and radiating asymmetrically in the azimuth plane. Measurement problems also spread out the gains above the second null.

Optionally, cables are allowed to vertically pass the antenna configuration. To allow one or more cables to pass vertically by the antenna, the cables are run parallel to the outermost layer of grids and outside of, and insulated from, the grids as shown in FIG. 1A.

Running the cables parallel to the outermost layer of grids minimizes shunting of the antenna by the cables and upsetting the azimuth patterns, since the cables are at the polarization shunted by the grids. To minimize further shunting by the cables in the area past the grids, the cables should be kept away from the top and bottom of the bicone, and thus should maintain at least the same radial distance from the bicone axis as in the area where the cables pass the outermost grid layer.

Describing the components of the antenna configuration in FIG. 1A in more detail, a bicone antenna 30 is made up of two cones, a top cone 18 and a bottom cone 20 arranged as shown. A coaxial cable 22 feeds the bicone at the feed point 26 of the antenna where the outer conductor 21 of the cable 22 is connected to the bottom cone 20 and the center conductor 23 of the cable 22 is connected to the top cone 18. The feed angle $\theta_F$ is the angle between the two cones at a feed point 26, and is usually picked so that the characteristic impedance $Z_0$ of the bicone is that of the coaxial cable (50 ohms) to ensure optimal match.

The bicone is wrapped in three layers 12, 14, 16 of grids of grid angles of 15, 30 and 45 degrees (see also FIGS. 1B, 1C, 1D), respectively, where the separation between adjacent grids or the innermost grid and the extreme edge of the bicone is a constant value. The grid layers are arranged radially so the layers of larger grid angles are of larger radius from the antenna axis 10.

The grid layers are kept separated by placing foam spacers between adjacent layers or between the innermost layer and the bicone, or by placing the whole configuration in a cylindrical dielectric box (not shown) whose top and bottom are mounted to the top and bottom of the bicone and whose top and bottom have slits on their insides in which the top and bottom edges of the grid layers are placed and held in place.

The height 24 of the grid layers are at least that of the height 24 of the bicone (FIG. 1A). Any cables 28 running vertically past the antenna 30 are run parallel to the grids of the outermost layer of grids and outside of, and insulated from the grids. In the same area past the grids, the cables preferably maintain at least the same radial distance from the bicone axis 10 as in the area where the cables pass the outermost grid layer. If there is more than one cable, the cables are placed symmetrically about the circumference of the outermost grid layer.

FIGS. 1B, 1C and 1D details the layers 12, 14, 16 of FIG. 1A with each layer unwrapped. A layer is made by etching or cutting metal 41 off of a plastic sheet 43. A typical way to un-join the layer from its cylindrical position about the bicone is to cut the layer along a line 40 parallel to and halfway between two of the grids making up the layer. It can be rejoined later with tape.

A grid 45 is a metal line that extends from the bottom to the top of the sheet having a height 24. The angle the grid makes with the horizontal is the grid angle $\theta_G$. In FIGS. 1B, 1C, 1D the grid angle $\theta_G$ is 45, 30 and 15 degrees, respectively. The width 32 of the grid compared to the width 34 of the non-gridded area of the sheet is somewhat arbitrary. The width 32 is non-critical as long as the extremes of the line width are not used. In FIG. 1B the metal width divided by the total width 36 available for a grid is 0.5.

The length of a grid line should be at least ½ wavelength, so it can reflect away the field parallel to the grids.

The number of grids on a sheet is determined by the required spacing between the grids. This spacing should be appreciably less than 1 wavelength for appreciable attenuation of the field parallel to the grids, as further discussed in the case of a bicone in internal grids below. Note that the actual number of grid lines is much larger than shown in FIGS. 1B to 1D.

Another possibility to reduce the effects of possible resonances and to reduce pattern degradation when the separation between the bicone and grids is one wavelength is to place the grids within the bicone as shown in FIG. 4.

The internal grid bicone antenna 51 of FIG. 4 includes a bicone having a height 59, two circumferential edges 57, and a radius 15 measured from the bicone or antenna axis 10. The antenna includes a top cone 18, a bottom cone 20, a feed angle $\theta_F$, a feed point 26, 15 degree grid layer 50, 30 degree grid layer 52 and 45 degree grid layer 54.

An internal grid bicone antenna reduces resonance effects since the grids are more highly coupled to the bicone and are thus less a parasite. If the layers are small enough in circumference, operation below the first resonance, where the circumference is one wavelength, is possible. Also the null frequency, where the separation between the bicone axis and innermost grid is one wavelength, is pushed to higher frequencies since the separation is reduced. Thus the antenna configuration can be used at higher frequencies. However, several problems arise from this configuration.

Placing the grids within the bicone starts to defeat the purpose of the grids, which is to rotate the field for an antenna behind the grids. In the internal grid configuration, part of the bicone is behind the grids in the rotated field, and part of the bicone is ahead of the grids in the field that has not yet been rotated.

The part of the bicone ahead of the grids is the two horizontal edges 57 of the bicone, which act as a pair of horizontal grids. Long grids start to allow the field they are supposed to block, i.e., the field parallel to the grids, to pass at roughly when the spacing between the parallel grids is 1 wavelength. Thus, below 1 wavelength the two horizontal edges 57 of the bicone can block horizontal polarization from being received by the grids and bicone. Thus the height 59 of a wide internal grid bicone must be at least 1 wavelength for horizontal response to equal vertical response.

For an idea of the approximate amount of blockage that a layer of grids can achieve to polarization parallel to the grids, below is a representative TABLE 2 of the amount of field blockage of grids versus grid separation obtained from NEC from a dipole probe in front of a 2 wavelength by 2 wavelength sheet of grids.

TABLE 2

| Number of Grids | Grid Separation (wavelengths) | Rejection (db) |
|---|---|---|
| 3 | 1 | 0.5 (interpolated) |
| 5 | 1/2 | 2 |
| 6 | 3/8 | 2.5 |
| 9 | 1/4 | 4.5 |
| 17 | 1/8 | 9.5 |
| 33 | 1/16 | 16 |

The cases with a small number of grids in Table 2 above may be suspect since only a 2 wavelength by 2 wavelength sheet of grids was used.

Placing the grids within the bicone increases the cut-in frequency of the bicone more than what occurs with bicones with external grids. The cut-in frequency is defined as the frequency where the VSWR (Voltage Standing Wave Ratio) about the characteristic impedance $Z_o$ of the antenna becomes a low, flat level. This is because the grids are shunting the bicone at a point closer to the bicone feed point 26.

Vertical passage of cables past a bicone in either external or internal grids is done by having the cable follow the path of the grids of the outermost grid layer outside of the outermost grid layer. Since grids shunt any field along their direction, the antenna impedance-wise will usually not see the cable at the frequencies where it is of low impedance, being those frequencies above cut-in. Below cut-in, the bicone and similarly sized grids have high impedance and thus coupling to lower impedance longer cables going past the bicone is possible resulting in the cables becoming part of the antenna and radiating usually undesirable patterns. Obviously, this is an undesirable property if operation below cut-in is important.

SUMMARY OF THE INVENTION

Accordingly, it is an object of the present invention to provide a vertically polarized dipole or bicone antenna positioned cylindrically within many cylindrical layers of polarizing grids that slowly rotate the incident field to cross 0 degrees, i.e., 90 degrees to the horizon, to attenuate or minimize the effects of gain nulls from reflections off of the innermost grid layer. Such an antenna is used for detecting both horizontal and vertical polarized signals over a broad bandwidth whereby the response to both polarizations is equal.

Other objects and advantages of the present invention will be apparent in view of the following description, drawings and claims.

DETAILED DESCRIPTION OF THE INVENTION

Figure 5A:
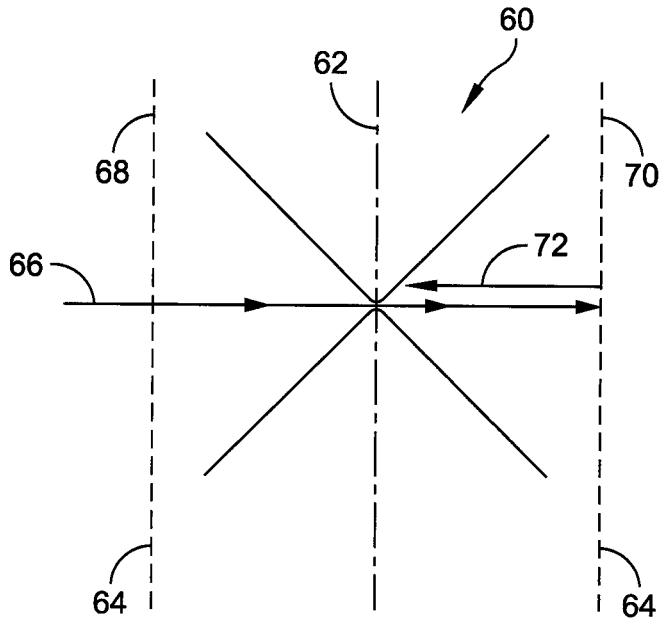
FIG. 5A is a diagram illustrating the creation of cancellation nulls in an external grid bicone antenna.
Figure 5B:
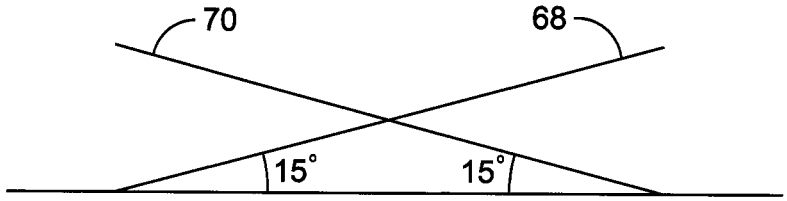
FIG. 5B is a diagram illustrating the 15 degree angle direction of a 15 degree grid on the front side and back side of the circumference of the grid, when viewed from a given azimuth.

A possible mechanism for the creation of the cancellation nulls between the innermost layer of grids and the bicone is shown in FIGS. 5A, 5B. In FIG. 5A, a bicone 60 with an axis 62 is shown radially wrapped within the innermost layer 64 of grids. An incident wave 66 impinges on what is considered the front 68 of the grid layer 64, which typically is composed of a multitude of grids at a low pitch angle of 15 degrees.

The portion of the wave 66 which is passed by the grid continues to the bicone for reception. The wave 66 continues past the bicone 60 to the opposite side of the grids, considered to be the backside 70 of the innermost layer 64 of grids. At the backside 70, a significant part of the wave is reflected back (reflected wave 72) with the addition of 180 degrees of phase, since the backside direction of the grids is opposite to that of the front of the grids.

FIG. 5B illustrates the example of a 15 degree grid where if the front 68 of the grids is pitched 15 degrees to the right, then the pitch angle of the grids on the backside 70 is 15 degrees to the left.

A significant component of the backside grids 70 is parallel to the wave that is perpendicular to and passed by the front of the grids 68, which allows reflection of a significant part of the wave. The reflected wave 72 is reflected to the bicone axis 62. If the path length from the bicone axis to the grids is n/2 wavelengths, where n is an integer, the total path length from the axis to the grids and back to the axis is 2 times n times 180 degrees, or effectively 0 degrees. Thus the reflected wave 72 arrives 180 degrees out of phase at the antenna axis (bicone axis) 62 with the incident wave, which causes cancellation.

As opposed to a dipole, measurements have shown that cancellation actually starts at 1 instead of ½ wavelength path lengths for the bicone. This may be explained by the fact that a bicone occupies a large part of the path from the antenna axis to the grids. This occupation of space may effect the electrical path length at ½ wavelength distances.

A solution to the cancellation causing reflections is to disallow reflections. When the incident wave is at the backside of the grids, no component of the grids at this location can be parallel to the incident wave. This is only possible if the grids on the front and back line up in the same direction. The only two possibilities for this solution are either, the grids are vertical 90 degree grids, or the grids are horizontal 0 degree grids.

Zero degree grids is an acceptable solution since they only pass vertical polarization which is the final polarization of the receiving bicone used when a bicone grid configuration is implemented to rotate the 45 degree polarized incident wave to the vertical polarization of the bicone.

The solution is to add a layer of 0 degree grids between the innermost grid layer and the bicone. This layer has the following two properties. First, it is compatible with the original configuration since it, not the bicone, will be the final component to rotate the field to vertical. Second, its presence as the innermost grid layer will ensure that no reflections occur inside the layer that may place a cancellation point on the bicone axis.

Figure 6:
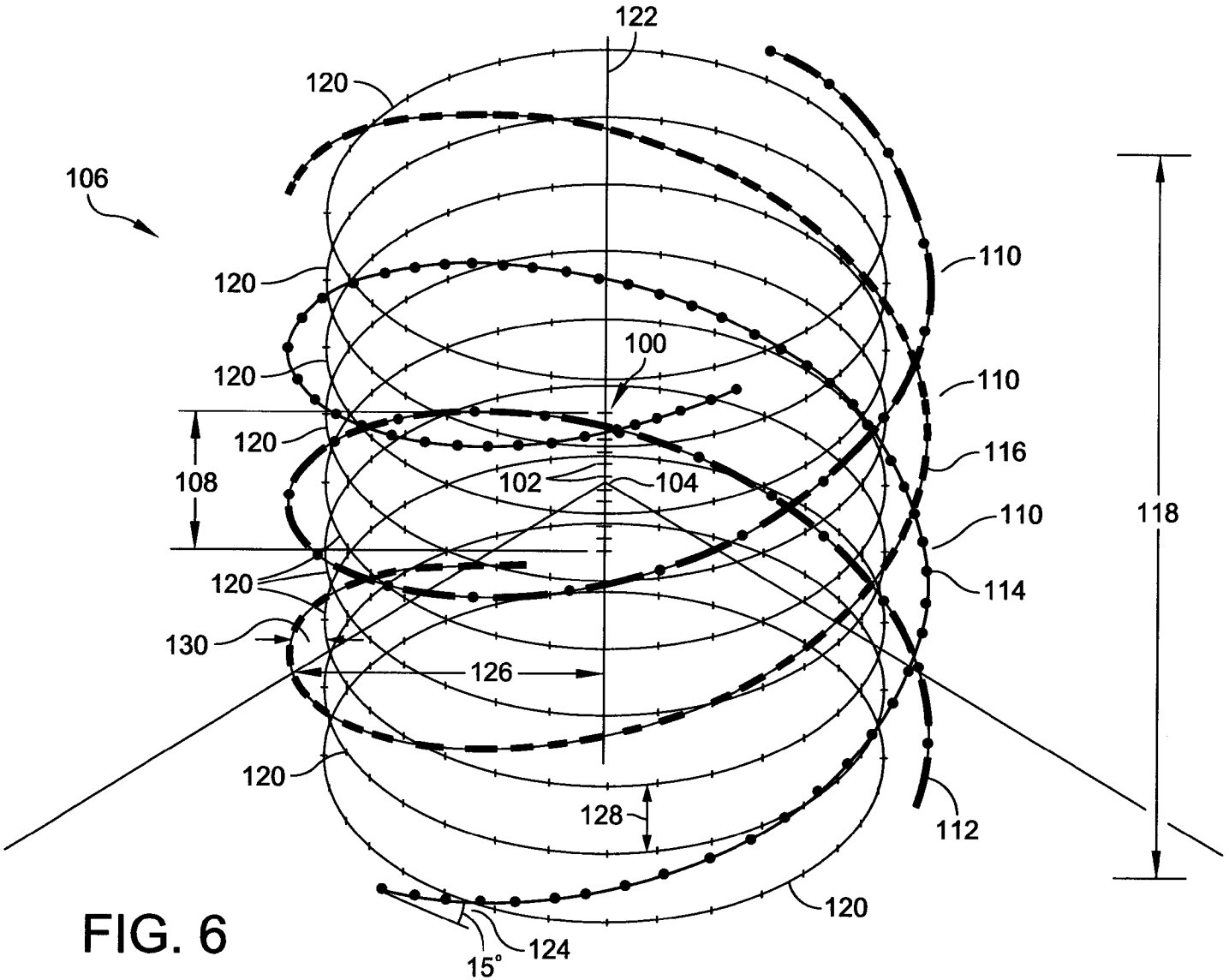
FIG. 6 is a three-dimensional diagram of a dipole circumferentially wrapped with 0 and 15 degree grid layers.

The above concept was initially investigated with NEC by placing a vertical dipole in the center of a layer of three cylindrical 15 degree grids as shown in FIG. 6.

Referring to FIG. 6, a dipole 100 is composed of eleven segments 102 each having end points marked with a tick mark. The center segment 104 of the dipole 100 is the feed point of the whole antenna configuration 106. The length 108 of the dipole 100 is chosen so that it is ½ wavelength at a frequency of 1 Gigahertz. The dipole 100 is used to probe the fields inside the antenna configuration, primarily to determine the behavior of the grids.

A layer 110 of cylindrical polarizing grids is centered about the axis 122 of the dipole 100. The layer 110 in this example is composed of three grids 112, 114 and 116. In this example, each grid within the layer 110 has a 15 degree pitch angle 124 with the horizon. The grid layer 110 was chosen to represent the innermost layer of grids of an antenna grid configuration. The radius 126 of the 15 degree grid layer 110 is chosen to be 1 wavelength at 1 GHz so that the behavior of the grids 112, 114, 116 as a function of radial size in wavelengths can be directly determined from the frequency.

The height 118 of the grid layer 110 is two wavelengths at 1 GHz, a size more than adequate to surround the space around the dipole 100. A second layer of 0 degree grids 120 is inserted between the 15 degree layer 110 and the dipole. At 1 GHz the vertical separation 128 between grids is ¼ wavelength, and the horizontal separation 130 between the layers is ⅛ wavelength.

Additional charts similar to FIG. 6 (not shown) could be presented to represent any grid layers, such as 30, 45 or any other degree angles. If only two grid layers were used, the preferred layers would be 0 degree and 45 degree layers.

Figure 7:
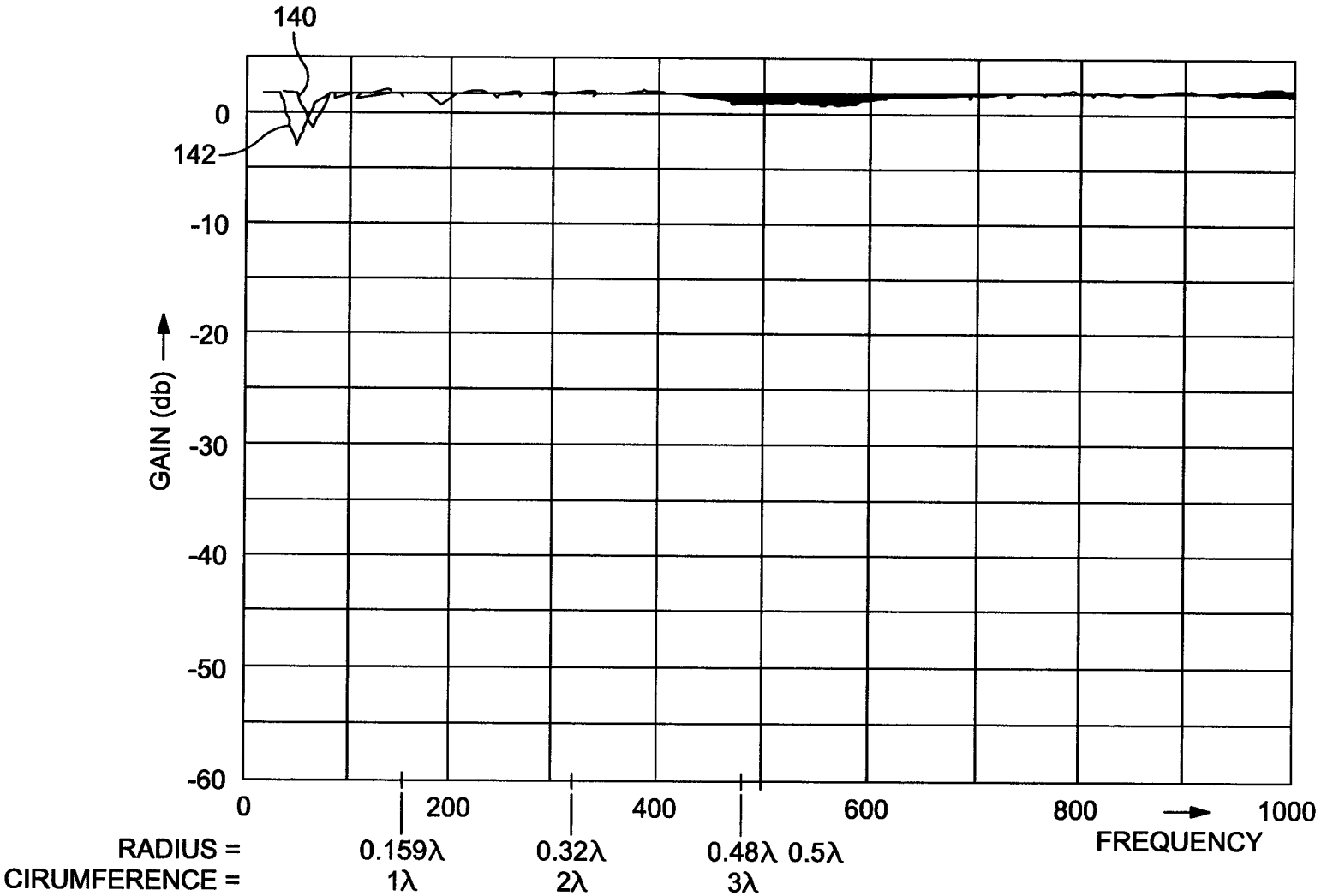
FIG. 7 is a gain versus frequency graph of the dipole of FIG. 6 illustrating the different vertical dipole response curves for the dipole having only a 15 degree grid layer, and having both 0 and 15 degree grid layers in accordance with the principles of the invention.
Figure 8:
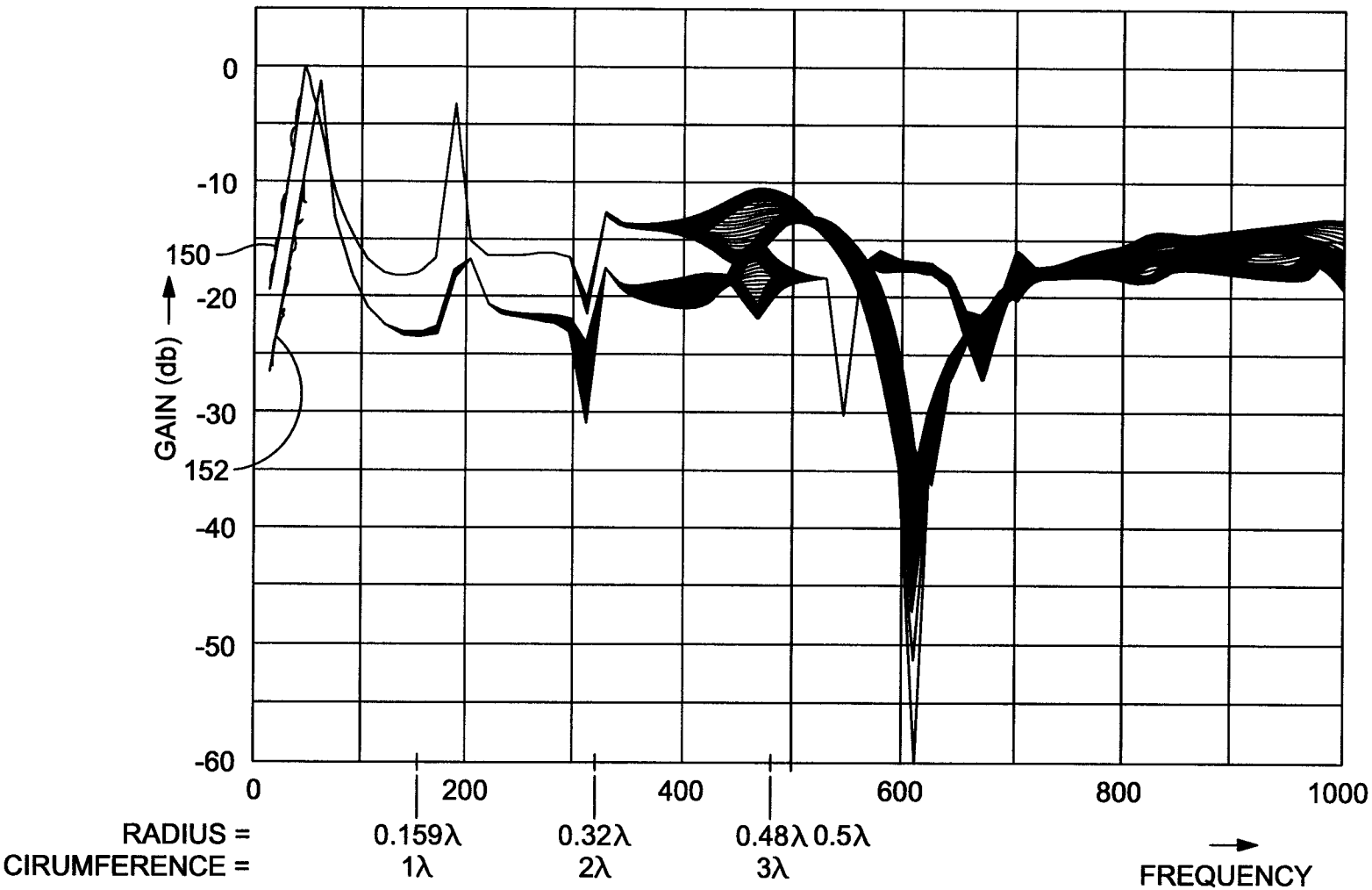
FIG. 8 is a gain versus frequency graph of the dipole of FIG. 6 illustrating the different horizontal dipole response curves for the dipole having only a 15 degree grid layer, and having both 0 and 15 degree grid layers in accordance with the principles of the invention.

The analysis and results of the dipole antenna configuration of FIG. 6 are shown in FIGS. 7 and 8. FIG. 7 displays a vertical response curve 142 of gain in decibels versus frequency in Megahertz of a dipole with 15 degree grids. The frequency axis also identifies radius values and circumference values of the 15 degree grids in wavelengths λ. The response curve 140 includes the effects of the addition of a layer of 0 degree grids between the innermost 15 degree layer and the dipole.

FIG. 8 displays a horizontal response curve 150 of gain in decibels versus frequency in Megahertz of a dipole with 15 degree grids. The frequency axis also identifies radius values and circumference values of the 15 degree grids in wavelengths λ. The response curve 152 includes the effects of the addition of a layer of 0 degree grids between the innermost 15 degree layer and the dipole.

FIGS. 7 and 8 further illustrate the azimuthal response at all azimuths for horizontal and vertical polarization. The horizontal response curve 152 of FIG. 8 shows significant results. Without the 0 degree layer, gain nulls are seen from the response curve 150 at the 15 degree grid circumferences of approximately 1, 2 and 3 wavelengths with null depth generally decreasing with wavelength. These nulls are due to circumferential resonances. The first cancellation from reflection from the 15 degree grid layer is seen from the response curve 150 at the grid layer radius being 0.61 wavelengths, which is slightly higher than the expected cancellation at 0.5 wavelengths for the case when the antenna is a dipole. This is most likely due to the fact that the grids are circular instead of flat, and thus their backside is effectively a little closer to the dipole. When the zero degree layer is added, significant reduction of the gain dip can be seen from the response curve 152. The dip is shifted right a little. However, there is no reduction in the gain nulls of the resonances.

The vertical plots of FIG. 7 show little perturbation likely due to the small number of grids in the 15 degree layer, and due to the 15 degree grids having only a small vertical component.

Figure 9A:
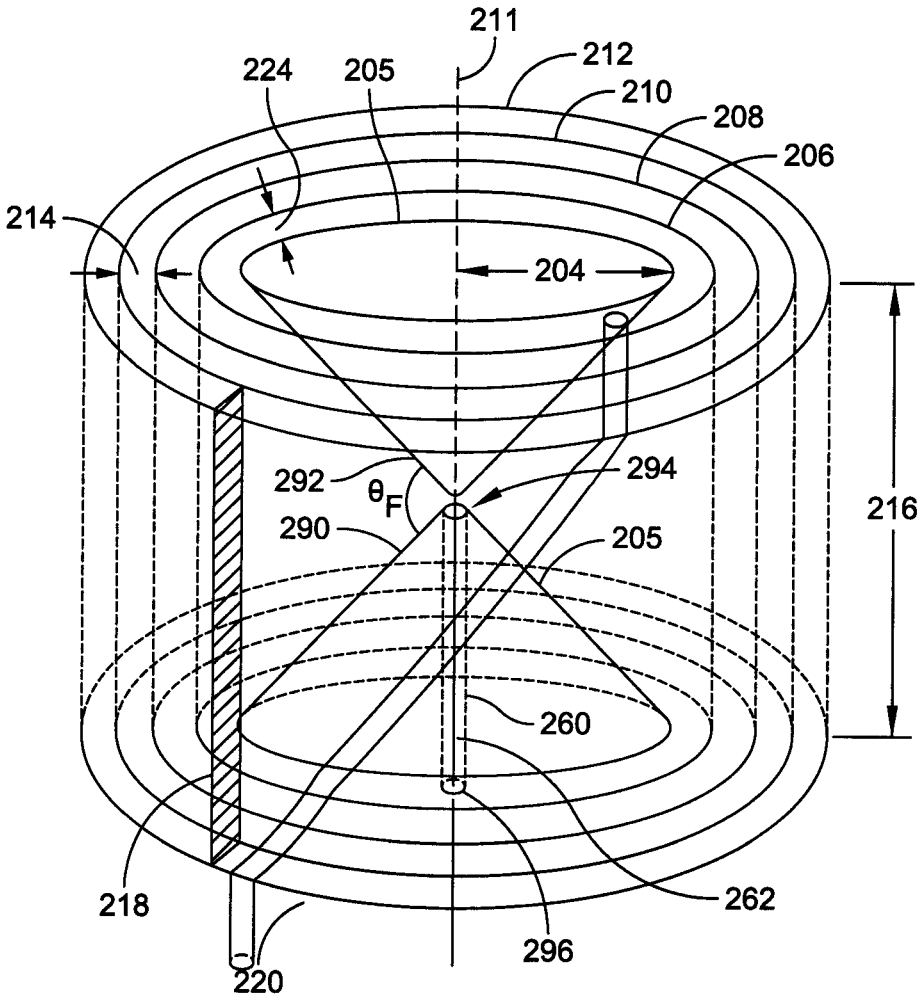
FIG. 9A is a drawing of an external grid bicone antenna configuration having 0, 15, 30 and 45 degree grid layers in accordance with the principles of the invention.

A configuration of a preferred embodiment of a bicone antenna according to the principles of the invention is shown in FIG. 9A. The antenna configuration is similar to that of FIG. 1A except for the addition of a 0 degree grid layer 206 between the innermost 15 degree grid layer 208 and the radius 204 of the bicone antenna 205.

FIG. 9A shows a bicone antenna 205 having a bottom cone 290 and a top cone 292, both of which are made of a conductive, low loss metal such as copper or aluminum and having a feed point 294 with coaxial cable 296 (e.g., 0141 inch semi-rigid cable). At the feed point 294, the outer conductor 260 of the cable 296 is connected to the bottom cone 290, and the inner conductor 262 is connected to the top cone 292. The top and bottom cones are angularly separated by a feed angle $\theta_F$.

Figure 1A:
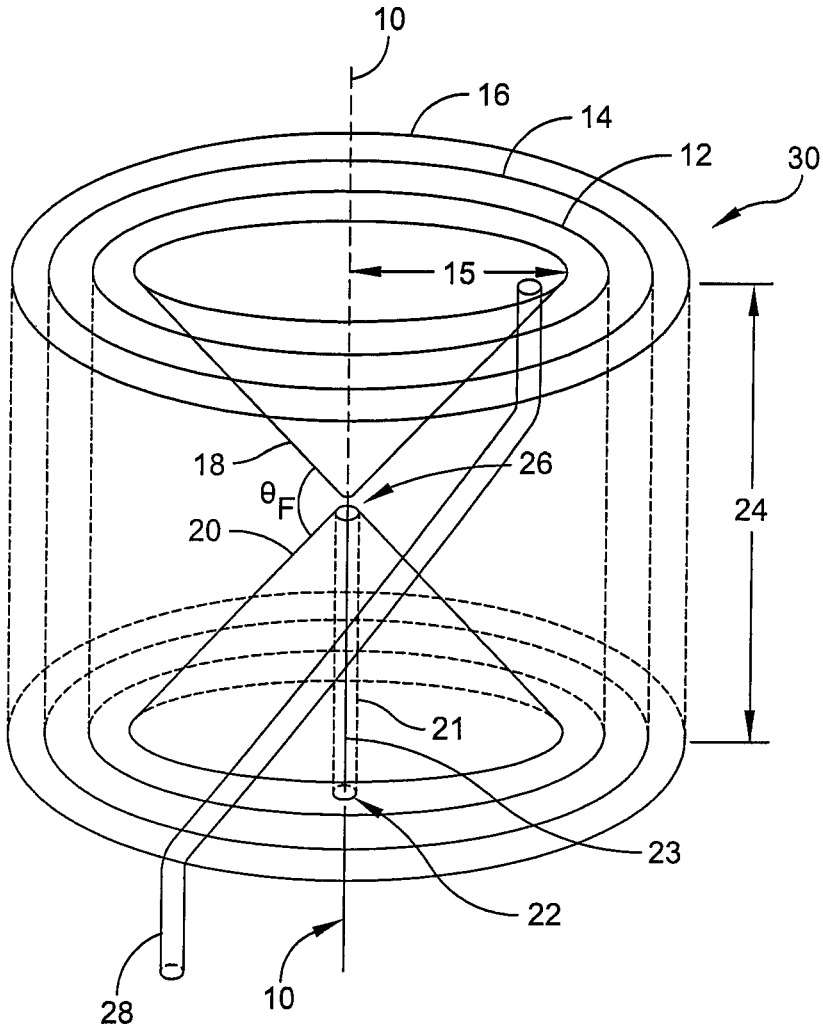
FIG. 1A (PRIOR ART)
FIG. 1A is a prior art drawing of an external grid bicone antenna configuration having 15, 30 and 45 degree grid layers.
Figure 1B:
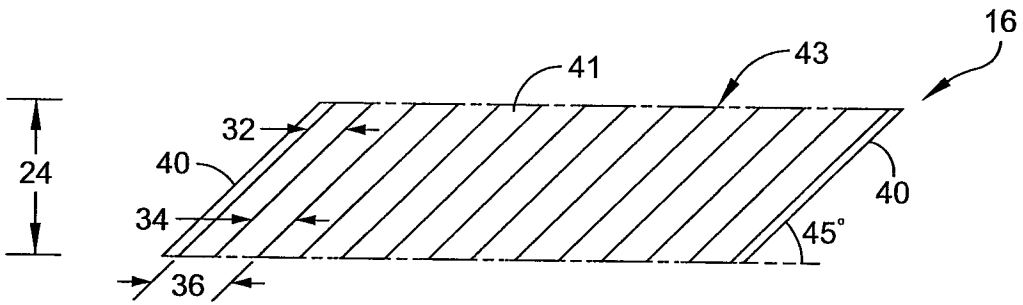
FIG. 1B (PRIOR ART)
FIG. 1B is a diagram of the unraveled 45 degree grid layer of FIG. 1A.
Figure 1C:
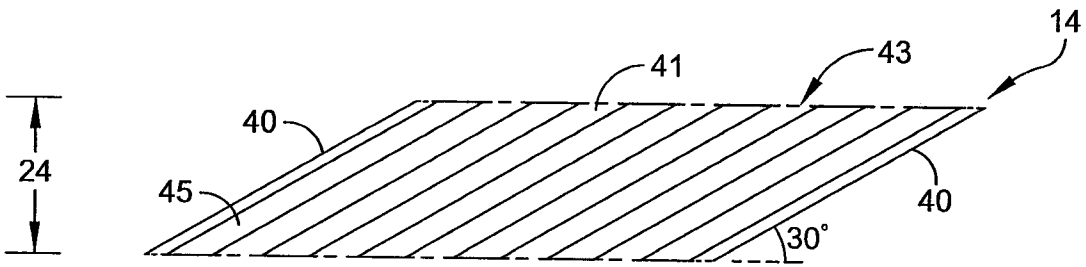
FIG. 1C (PRIOR ART)
FIG. 1C is a diagram of the unraveled 30 degree grid layer of FIG. 1A.
Figure 1D:
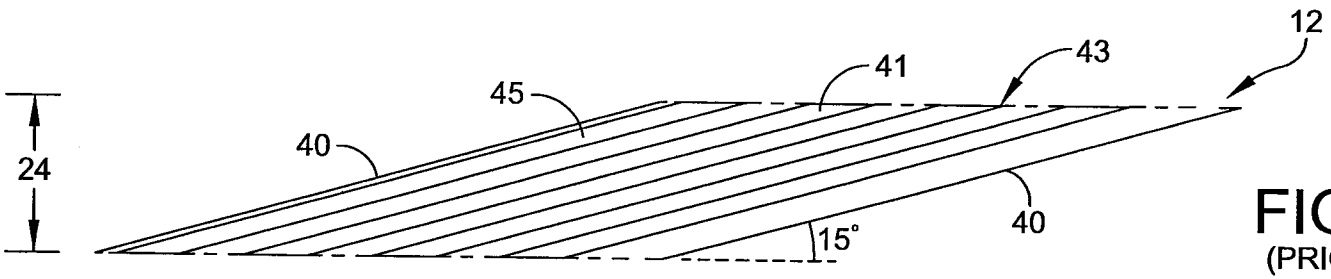
FIG. 1D (PRIOR ART)
FIG. 1D is a diagram of the unraveled 15 degree grid layer of FIG. 1A.
Figure 2:
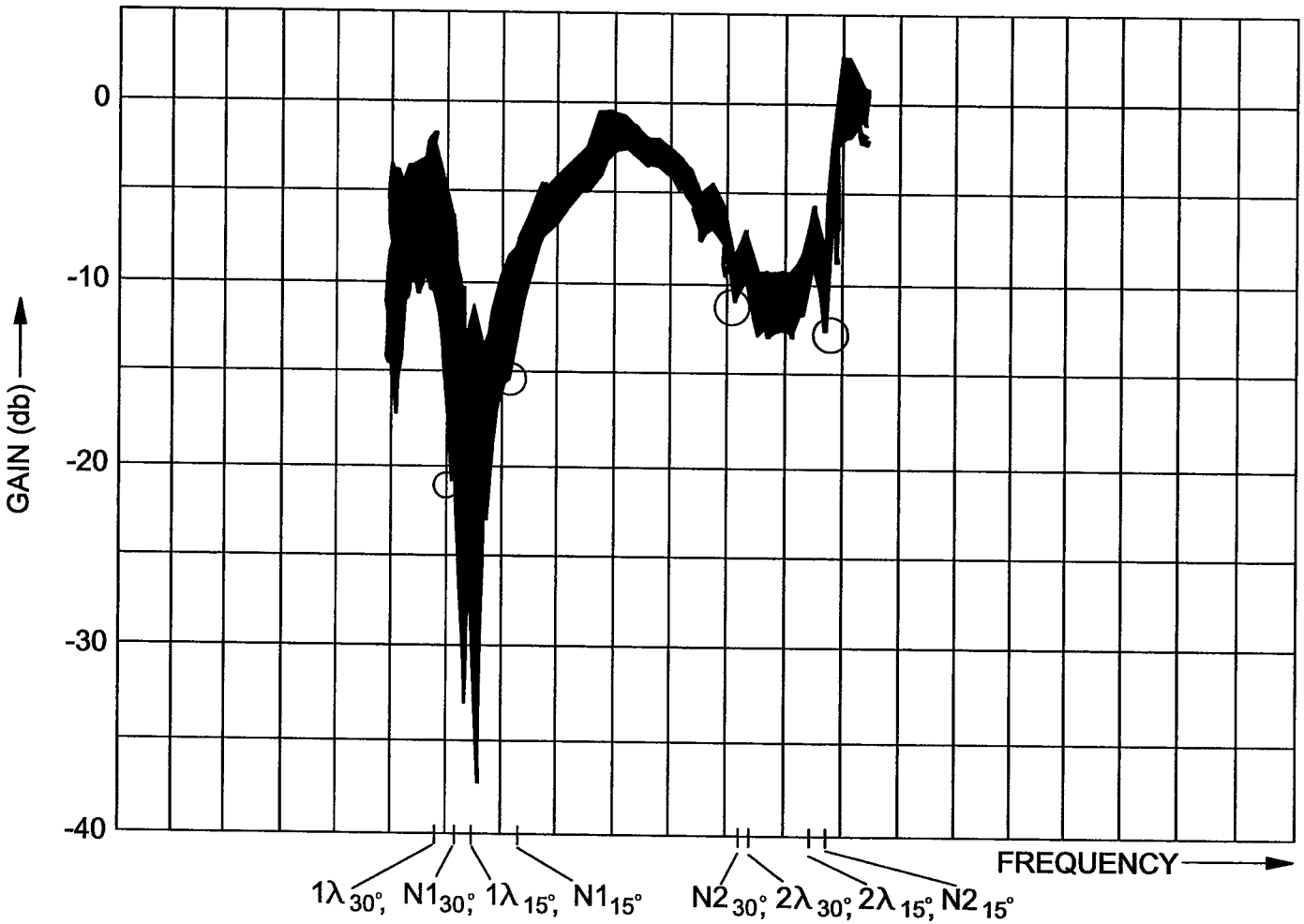
FIG. 2 (PRIOR ART)
FIG. 2 is a graph of vertical polarization gain versus frequency for all azimuths of the bicone antenna of FIG. 1 without the 45 degree grids.
Figure 3:
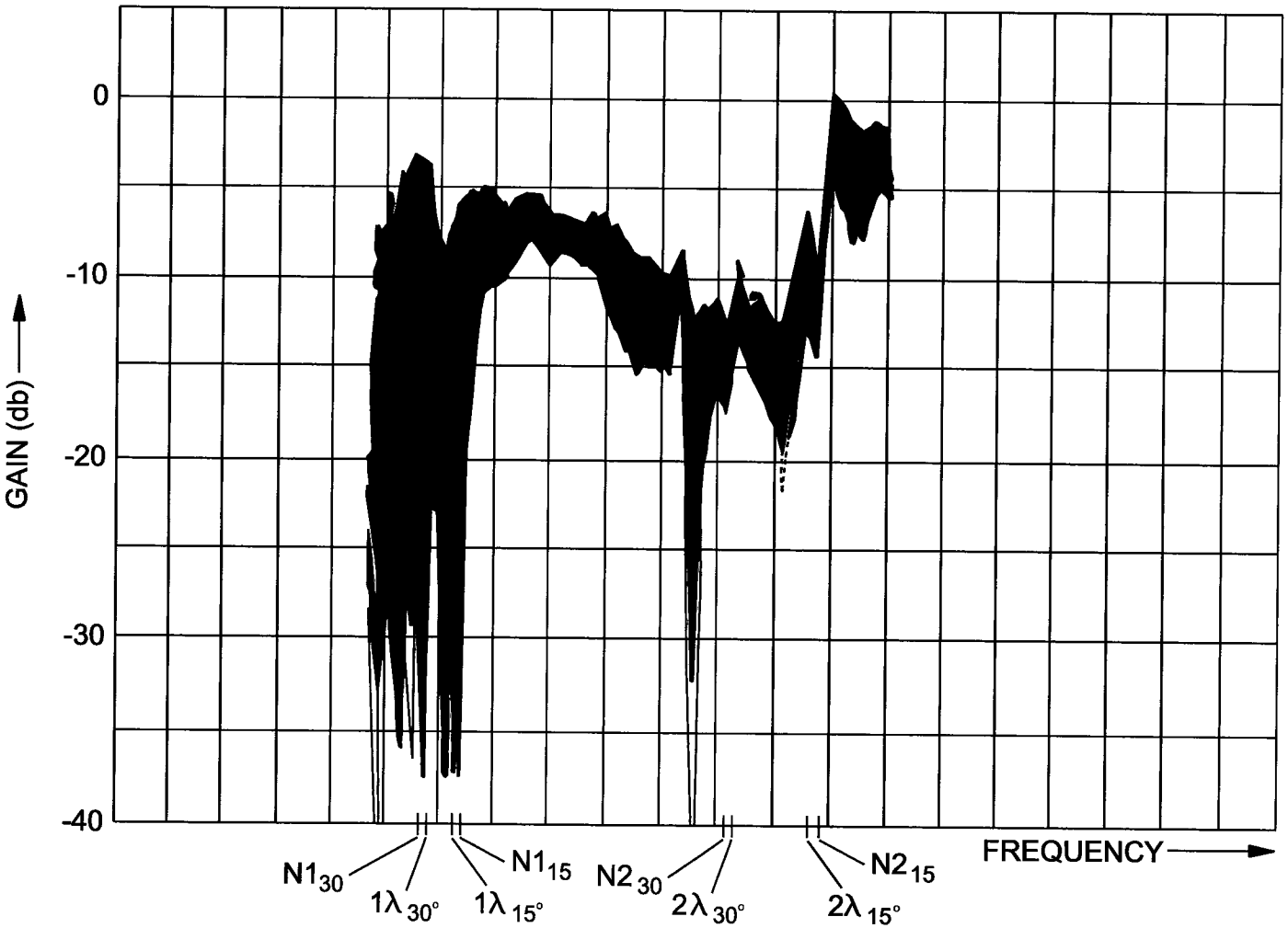
FIG. 3 (PRIOR ART)
FIG. 3 is a graph of horizontal polarization gain versus frequency for all azimuths of the bicone antenna of FIG. 1 without the 45 degree grids.
Figure 4:
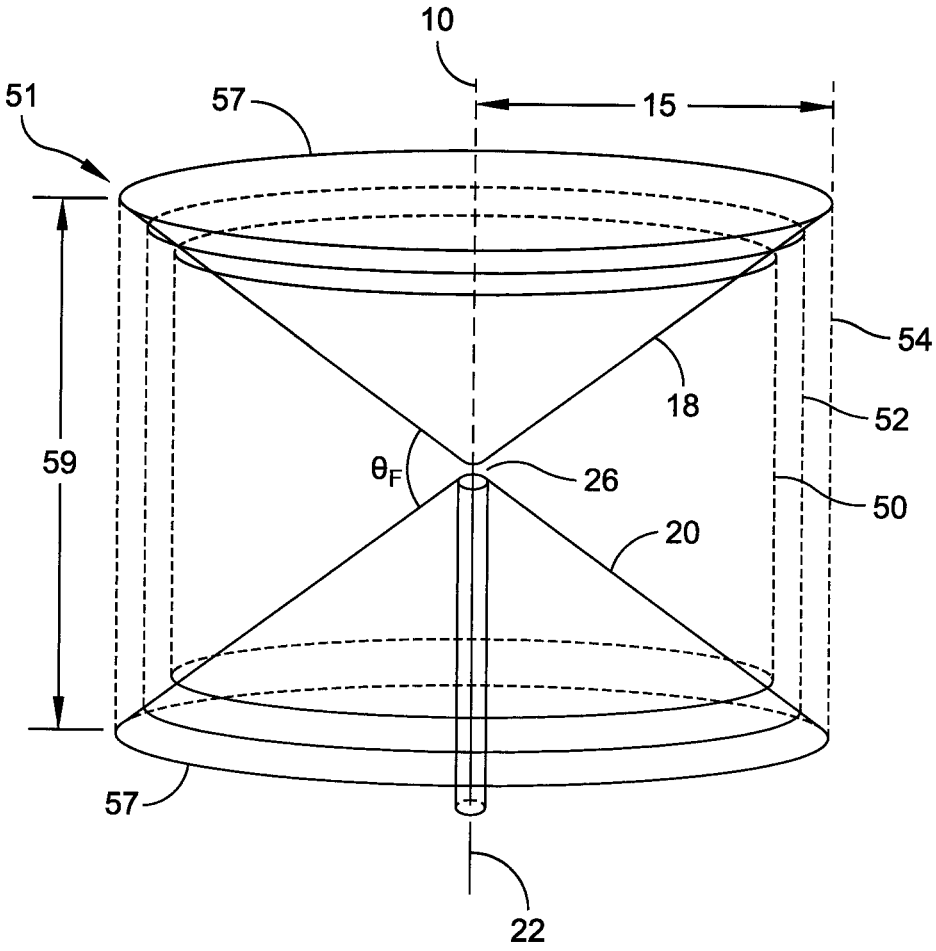
FIG. 4 (PRIOR ART)
FIG. 4 is a prior art drawing of an internal grid bicone antenna configuration having 15, 30 and 45 degree grid layers.

The bicone 205 has a radius 204 and a height 216. The bicone 205, similar to the bicone 30 shown in the prior art of FIG. 1A, is wrapped with an innermost layer 208 of 15 degree grids, a layer 210 of 30 degree grids, and a layer 212 of 45 degree grids. What is new is that the bicone antenna 205 includes a 0 degree grid layer 206 wrapped between the bicone and the innermost 15 degree grid layer 208.

The separation 214 between adjacent grid layers and the separation 224 between the innermost grid layer and the extreme edge of the bicone 205 are constant values. The grid layers are arranged radially so that the layers of larger grid angles have corresponding larger radii. In other word, a grid layer's pitch angle will increase directly with an increase in radius.

The grid layers are kept separated by placing foam spacers (see the cross section 218 of one spacer) between adjacent layers or the 0 degree layer 206 and the bicone 205.

Alternatively, the whole antenna configuration could be placed into a cylindrical dielectric box (not shown) whose top and bottom are mounted, respectively, to the top and bottom of the bicone and whose top and bottom have slits on their insides in which the top and bottom edges of the grid layers are placed and held in place.

The height 216 of the grid layers is at least that of the bicone. Any cables 220 running vertically past the antenna are run parallel to the grids of the outermost layer of grids and outside of, and insulated from, the grids. In the area past the grids, the cables preferably maintain at least the same radial distance from the bicone axis 211 as in the area where the cables pass the outer most grid layer 212. If there is more than one cable, the cables are placed symmetrically about the circumference of the outer most grid layer 212.

Figures 9B, 9C, 9D, 9E:
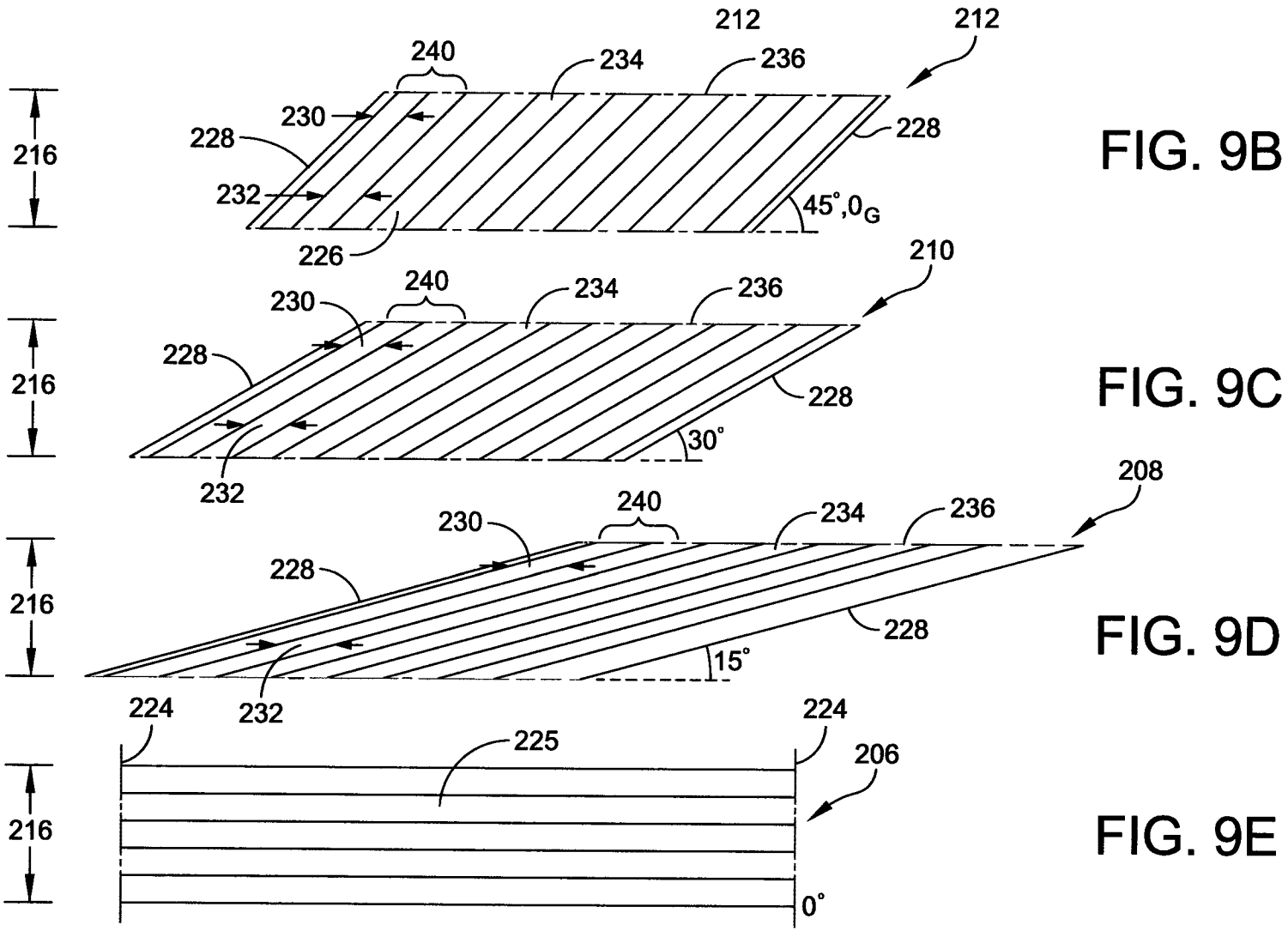
FIG. 9B is a diagram of the unraveled 45 degree grid layer of FIG. 9A.
FIG. 9C is a diagram of the unraveled 30 degree grid layer of FIG. 9A.
FIG. 9D is a diagram of the unraveled 15 degree grid layer of FIG. 9A.
FIG. 9E is a diagram of the unraveled 0 degree grid layer of FIG. 9A.

FIG. 9B is a diagrammatic representation of the unwrapped 45 degree grid layer; FIG. 9C is a diagrammatic representation of the unwrapped 30 degree grid layer; FIG. 9D is a diagrammatic representation of the unwrapped 15 degree grid layer; and FIG. 9E is a diagrammatic representation of the unwrapped 0 degree grid layer.

In FIGS. 9B-E, a grid layer is made by etching or cutting metal 234 off of a plastic sheet 236. A typical way to un-join the grid layer from its cylinder about the bicone is to cut the layer along a line 228 parallel to and halfway between two of the grids making up the layer. It can be rejoined later with tape. The exception is the 0 degree grid layer where the sheet is cut (see line 224) across the grids 225 and rejoined with tape for the sheet and with solder for the grids.

A grid 226 is a metal line that extends from the bottom to the top of the sheet or around the sheet for the 0 degree layer. The angle the grid makes with the horizontal is the grid angle $\theta_G$. In FIGS. 9*b*, 9*c*, 9*d* and 9*e* the grid angle $\theta_G$ is respectively 45°, 30°, 15° and 0°.

The metal width 230 of each grid compared to the width of the non-gridded area 232 of the sheet is somewhat arbitrary. The width 230 is non-critical as long as the extremes of the line width are not used, i.e., the metal width 230 divided by total width available for a grid line 240 is greater than 0 and less than 1. In FIG. 9B, the metal width 230 divided by the total width available for a grid line 240 is 0.5.

The length of a grid line should be at least ½ wavelength, so it can reflect away the field parallel to the grids.

The number of grids on a sheet is determined by the required spacing between the grids. This spacing should be appreciably less than 1 wavelength for appreciable attenuation of the field parallel to the grids.

Figure 10:
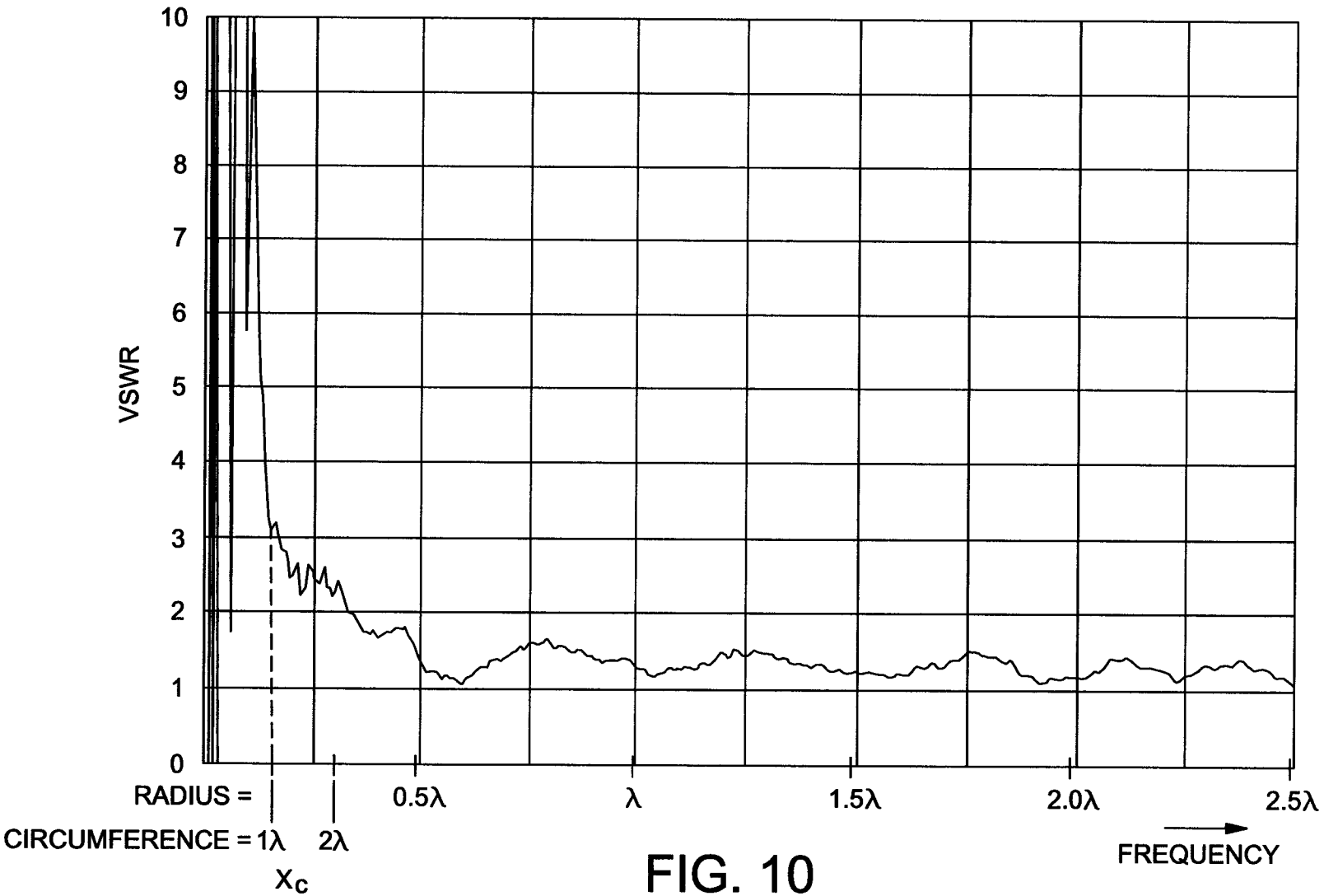
FIG. 10 is a graph of VSWR versus frequency of the bicone of FIG. 9A.
Figure 11:
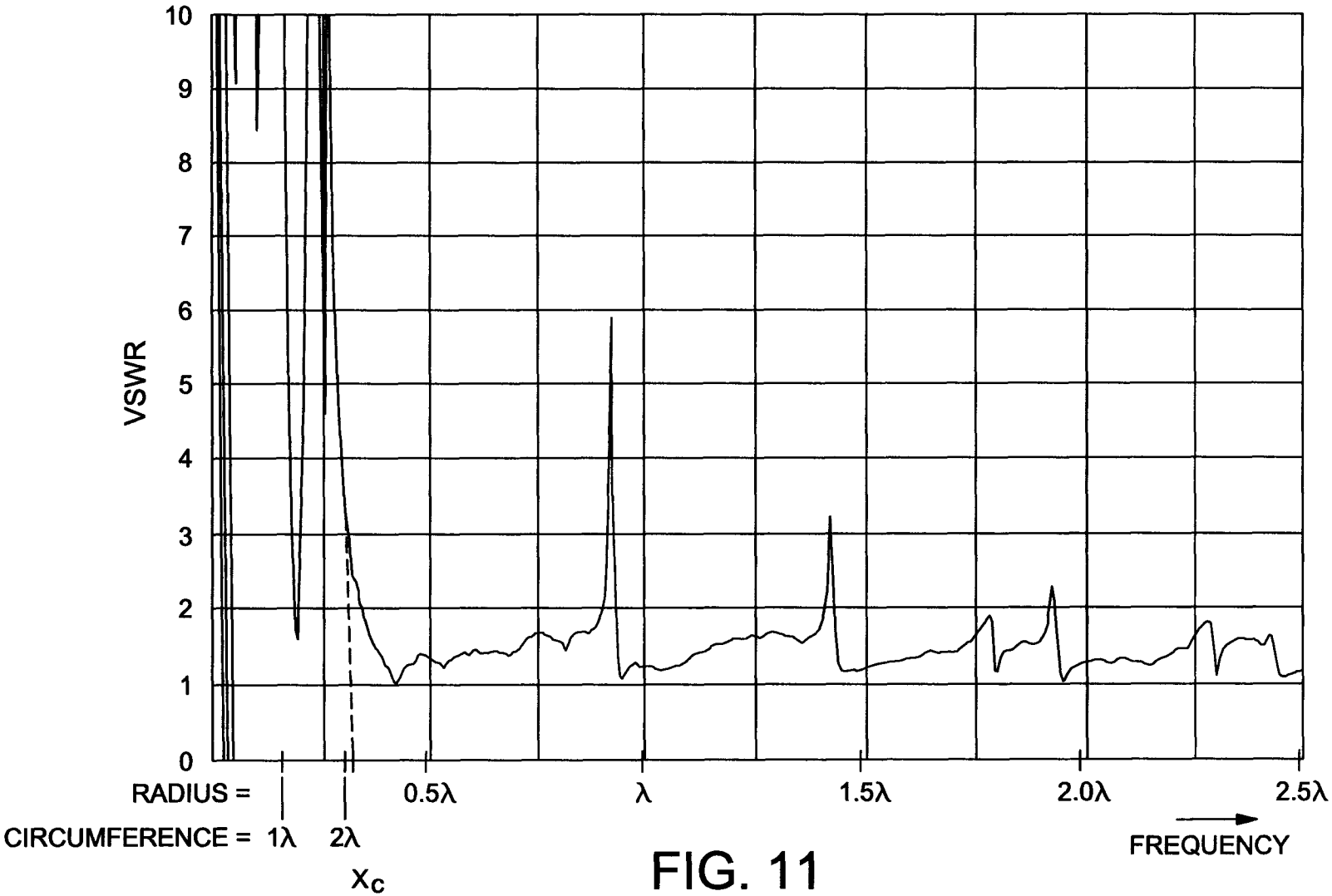
FIG. 11 is a graph of VSWR versus frequency of the bicone of FIG. 9A surrounded by 15, 30 and 45 degree grid layers.
Figure 12:
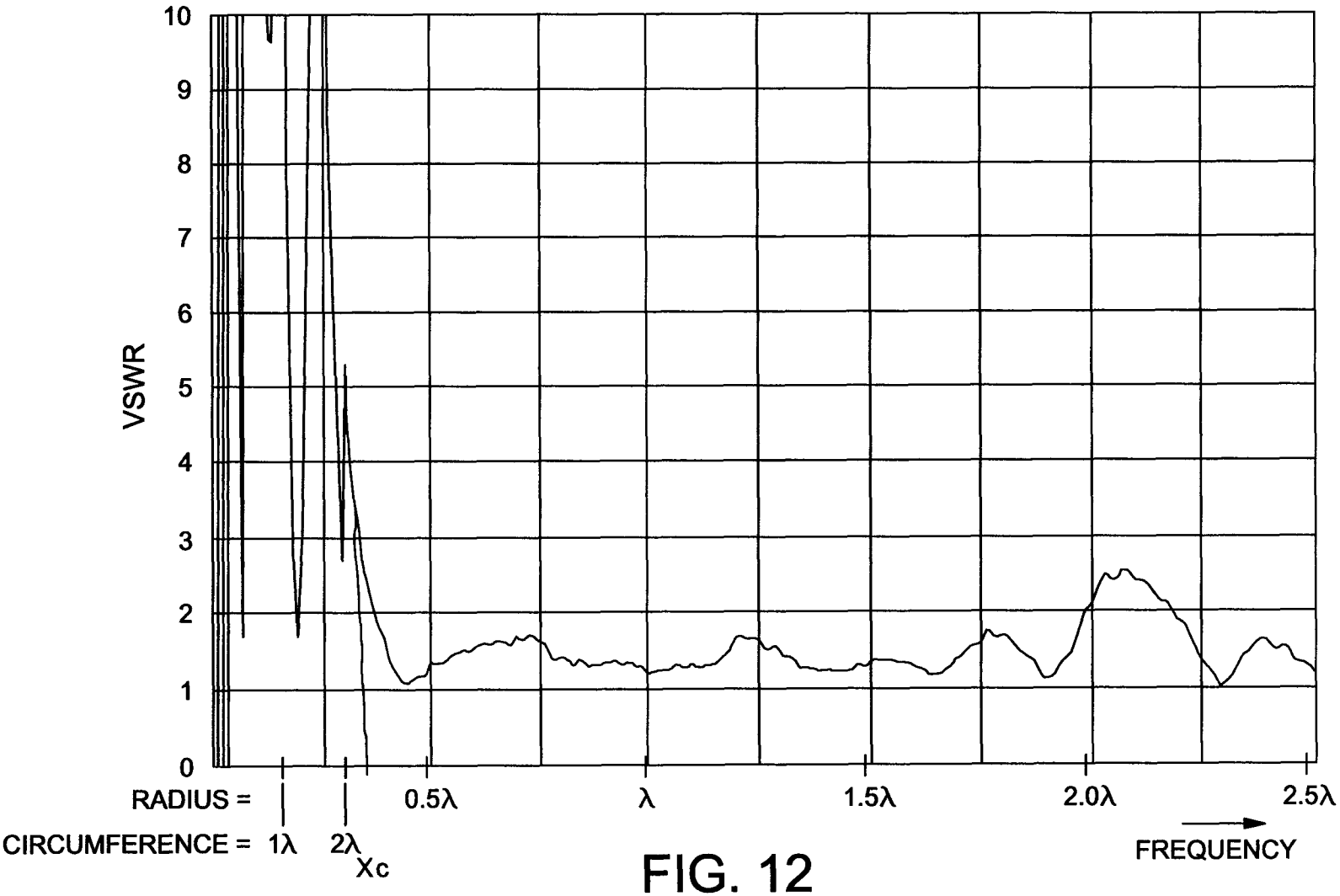
FIG. 12 is a graph of VSWR versus frequency of the bicone of FIG. 9A surrounded by 0, 15, 30 and 45 degree grid layers.

Measurements of actual antenna configurations were made and the results of the VSWR of a bicone of characteristic impedance $Z_o$ of approximately 50 ohms were made as summarized in FIGS. 10-12. FIG. 10 shows the VSWR versus frequency as well as the radius and circumference of the innermost grid layer of a bicone without any grid layers. FIG. 11 shows the VSWR versus frequency as well as the radius and circumference of the innermost grid layer of a bicone wrapped inside 15, 30 and 45 degree grid layers. FIG. 12 shows the VSWR of a bicone wrapped inside 0, 15, and 45 degree grid layers. The cut-in frequencies $X_C$ are shown in each of the drawings.

The VSWR of the bicone itself is low and approximately flat above the cut-in frequency $X_C$. When a common configuration of added 15, 30 and 45 degree grid layers is made, spikes in the VSWR are seen near frequencies where the radius of the innermost 15 degree grid layer is approximately 1, 1.5 and 2 wavelengths, and where the circumference of this layer is one wavelength. When a 0 degree grid layer is added between the bicone and the 15 degree grid layer, the spikes only associated with the radius disappear.

Likewise, gain versus frequency plots during testing showed that gain dips near 1, 1.5 and 2 wavelengths associated with the radius only disappear with the addition of the 0 degree grid layer. Gain dips near the circumferential integer multiples of wave length did not disappear. Thus, it may be concluded that the 0 degree grid layer prevents reflections within the inner most layer of grids and possible resultant gain nulls from cancellations caused by reflections. The VSWR and gain spikes or dips associated with the one wavelength circumference of the 15 degree grid layer did not disappear with the addition of the zero degree grids, and thus it may be concluded that the zero degree grid layer does not prevent grid circumferential resonances from degrading patterns.

Since the 0 degree grid layers prevent reflections, the distance between the innermost layer and the antenna axis is not critical. Increasing this distance will reduce the shunting effect of the grids on the bicone which raises the cut-in frequency of the bicone, evident by comparing the cut-in frequencies $X_C$ of FIGS. 10, 11 and 12. If this distance is made large enough, there is no rise in cut-in frequency. This is desirable since it allows a given sized bicone to work at the lowest possible frequency.

Although the preferred embodiments shown herein have been directed to a bicone antenna, the same principles are applicable to a dipole antenna. It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive or to limit the invention to the precise form disclosed; obviously many modifications and variations are possible in light of the above teaching. Such modifications and variations that may be apparent to a person skilled in the art are intended to be included within the scope of this invention as defined by the accompanying claims.

What is claimed is:

1. A polarized antenna comprising:

a bicone having a top conductive cone and a bottom conductive cone each of which have an identical conical radius $R_B$ and identical physical dimensions, wherein said top conductive cone and said bottom conductive cone are disposed in an oppositely directed stacked configuration along a vertical antenna axis, wherein the combined lengths of said top conductive cone and said bottom conductive cone equal a bicone height;

at least one grid layer of grid angle θ, where θ is greater than zero degrees but not greater than forty five degrees, each said grid layer having a grid height at least equal to the bicone height, each said grid layer wrapped one circumferential length around the top conductive cone and the bottom conductive cone in a cylindrical arrangement with a radius greater than the bicone radius $R_B$, and each said at least one grid layer having a constant space between any adjacent at least one grid layer, wherein the radius of each grid layer is directly related to a predetermined frequency; and a zero degree grid layer, with a grid angle of zero degrees with reference to an axis perpendicular to the vertical antenna axis, having a grid height equal to or larger than the bicone height and a radius $R_0$, where $R_0$ is greater than $R_B$, said zero degree grid layer wrapped one circumferential length around the top conductive cone and the bottom conductive cone in a cylindrical configuration disposed between the bicone radius $R_B$ and an innermost at least one grid layer.

2. The polarized antenna of claim 1, wherein said at least one grid layer further comprises a fifteen degree grid layer having a radius $R_{15}$ where $R_{15}$ is greater than $R_0$.

3. The polarized antenna of claim 2, wherein said at least one grid layer further comprises a thirty degree grid layer having a radius $R_{30}$, where $R_{30}$ is greater than $R_{15}$.

4. The polarized antenna of claim 3, wherein said at least one grid layer further comprises a forty five degree grid layer having a radius $R_{45}$, where $R_{45}$ is greater than $R_{30}$.

5. The polarized antenna of claim 1, wherein said at least one grid layer further comprises a fifteen degree grid layer having a radius $R_{15}$, a thirty degree grid layer having a radius $R_{30}$, and a forty five degree grid layer having a radius $R_{45}$, where $R_0$ is less than $R_{15}$, $R_{15}$ is less than $R_{30}$, and $R_{30}$ is less than $R_{45}$.

6. The polarized antenna of claim 1, wherein each of said at least one grid layer comprises a plurality of grids.

7. A polarized antenna comprising:

a bicone having a top conductive cone and a bottom conductive cone each of which have an identical conical radius $R_B$ and identical physical dimensions, wherein said top conductive cone and said bottom conductive cone are disposed in an oppositely directed stacked configuration along a vertical antenna axis, wherein the combined lengths of said top conductive cone and said bottom conductive cone equal a bicone height;

at least one grid layer of grid angle θ, wherein θ is greater than zero degrees but not greater than forty five degrees, wherein each at least one grid layer is wrapped one circumferential length around the bicone in a cylindrical configuration within the bicone radius $R_B$, and each said at least one grid layer having a constant space between any adjacent at least one grid layer wherein the radius of each grid layer is directly related to a predetermined frequency; and a zero degree grid layer, with a grid angle of zero degrees with reference to an axis perpendicular to the vertical antenna axis, of radius $R_0$ where $R_0$ is less than $R_B$, wherein said zero degree grid layer is wrapped one circumferential length around the bicone in a cylindrical configuration between the bicone and an innermost at least one grid layer.

8. The antenna of claim 7, wherein said at least one grid layer further comprises a fifteen degree grid layer having a radius $R_{15}$ where $R_{15}$ is less than $R_0$.

9. The antenna of claim 8, wherein said at least one grid layer further comprises a thirty degree grid layer having a radius $R_{30}$, where $R_{30}$ is less than $R_0$, and $R_{15}$ is less than $R_{30}$.

10. The antenna of claim 9, wherein said at least one grid layer further comprises a forty five degree grid layer having a radius $R_{45}$, where $R_{45}$ is less than but not greater than $R_0$, and $R_{30}$ is less than $R_{45}$.

11. The antenna of claim 7, wherein said at least one grid layers further comprises a fifteen degree grid layer having a radius $R_{15}$, a thirty degree grid layer having a radius $R_{30}$, and a forty five degree grid layer having a radius $R_{45}$, where $R_{15}$ is less than $R_{30}$, $R_{30}$ is less than $R_{45}$, and $R_{45}$ is not greater than $R_0$.

12. The antenna of claim 7, wherein each of said at least one grid layer comprises a plurality of grids.

13. A polarized antenna comprising;

a dipole having a dipole height;

at least one grid layer of grid angle θ, where θ is greater than zero degrees but not greater than 45 degrees, each said at least one grid layer having a grid height equal to or larger than the dipole height, each said at least one grid layer wrapped one circumferential length around the dipole, and each said at least one grid layer having a constant space between any adjacent at least one grid layer wherein the radius of each grid layer is directly related to a predetermined frequency; and a zero degree grid layer, with a gird angle of zero degrees with reference to an axis perpendicular to the dipole, having a grid height at least equal to the dipole height and a radius $R_0$, said zero degree grid layer wrapped one circumferential length around the dipole between the dipole and an innermost at least one grid layer.

14. The polarized antenna of claim 13, wherein said at least one grid layer further comprises a fifteen degree grid layer having a radius $R_{15}$, wherein $R_0$ is less than $R_{15}$.

15. The polarized antenna of claim 14, wherein said at least one grid layer further comprises a thirty degree grid layer having a radius $R_{30}$, wherein $R_{15}$ is less than $R_{30}$.

16. The polarized antenna of claim 15, wherein said at least one grid layer further comprises a forty five degree grid layer having a radius $R_{45}$, wherein $R_{30}$ is less than $R_{45}$.

17. The polarized antenna of claim 13, wherein said at least one grid layer further comprises a fifteen degree grid layer having a radius $R_{15}$, a thirty degree grid layer having a radius $R_{30}$, and a forty five degree grid layer having a radius $R_{45}$, wherein $R_0$ is less than $R_{15}$, $R_{15}$ is less than $R_{30}$, and $R_{30}$ is less than $R_{45}$.

18. The polarized antenna of claim 13, wherein each of said at least one grid layer comprises a plurality of grids.

19. A method of eliminating or reducing gain nulls in a polarized antenna having an antenna axis and an antenna height, the method comprising the steps of:

wrapping at least one grid layer of grid angle θ where θ is greater than zero degrees and less than or equal to forty five degrees, around one circumference of the antenna axis, each said at least one grid layer having a grid height equal to or larger than the antenna height, and each said at least one grid layer having a constant space between any adjacent at least one grid layer wherein the radius of each grid layer is directly related to a predetermine frequency; and reducing reflections off of an innermost at least one grid layer within the antenna by wrapping a zero degree grid layer, with a grid angle of zero degrees with respect to an axis perpendicular to the antenna axis, one circumference around the antenna axis between the antenna axis and an innermost at least one grid layer.

* * * * *